US006378138B1

(12) United States Patent
Ridgley et al.

(10) Patent No.: US 6,378,138 B1
(45) Date of Patent: Apr. 30, 2002

(54) HEAVENLY HOSIERY

(76) Inventors: Aleta O'Dell Ridgley; Mario Anthony Ridgley, both of 1749 Arash Cir., Port Orange, FL (US) 32124

( * ) Notice: Subject to any disclaimer, the term of this patent is extended or adjusted under 35 U.S.C. 154(b) by 0 days.

(21) Appl. No.: 09/837,513

(22) Filed: Apr. 19, 2001

(51) Int. Cl.[7] ..... A41B 11/00
(52) U.S. Cl. ..... 2/239
(58) Field of Search ..... 2/239, 240, 241, 2/242; 128/897

(56) References Cited

U.S. PATENT DOCUMENTS

| | | | | | |
|---|---|---|---|---|---|
| 2,569,398 | A | | 9/1951 | Burd et al. | 41/34 |
| 2,596,965 | A | | 5/1952 | Troy | 41/34 |
| 2,667,004 | A | | 1/1954 | Sanson | 41/34 |
| 3,922,723 | A | * | 12/1975 | Popper | 2/113 |
| 4,155,123 | A | * | 5/1979 | Popper | 2/239 |
| 4,206,514 | A | * | 6/1980 | Yamauchi | 2/239 |
| 4,228,549 | A | * | 10/1980 | Rispoli | 2/239 |
| 4,419,396 | A | * | 12/1983 | Sugimoto | 428/40 |
| 4,465,232 | A | * | 8/1984 | Field | 239/36 |
| 4,744,514 | A | * | 5/1988 | Gadoua | 239/36 |
| 5,678,251 | A | * | 10/1997 | Getz | 2/406 |
| 5,768,713 | A | * | 6/1998 | Crick | 2/409 |
| 5,809,577 | A | * | 9/1998 | Getz | 2/406 |
| 5,823,432 | A | * | 10/1998 | Hogan | 239/36 |
| 6,014,973 | A | | 1/2000 | Kaufman | 128/897 |
| 6,089,953 | A | * | 7/2000 | Chen | 450/1 |

* cited by examiner

*Primary Examiner*—John J. Calvert
*Assistant Examiner*—Alissa L. Hoey
(74) *Attorney, Agent, or Firm*—Patent & Trademark Services; Thomas Zack; Joseph H. McGlynn

(57) ABSTRACT

A stocking or hosiery which incorporates various types of healing devices such as, but not limited to, crystals for healing various bodily ailments. The naturally occurring elements may be incorporated into various different locations of pantyhose/stockings including the waistband, the area immediately below the waist, the knees, ankle bands and the outline areas of the pantyhose.

9 Claims, 4 Drawing Sheets

HEAVENLY HOSIERY

BACKGROUND OF THE INVENTION

This invention relates to a stocking that incorporates various types of healing devices such as, but not limited to, crystals for healing various bodily ailments.

Various types of devices for various reasons have been attached to wearing apparel. For example in one earlier invention, an ornament for a stocking is attached by fusing is disclosed. Another prior art invention discloses a stocking which has an ornament attached by adhesive.

Another invention discloses a stocking with an ornament which can be detachably mounted on hosiery. Still another invention discloses various healing elements which are worn on the body of a user, for example in a pouch.

DESCRIPTION OF THE PRIOR ART

Stockings or other wearing apparel which incorporate other devices are disclosed in the known in the prior art. For example, U.S. Pat. No. 2,569,398 to Burd et al. an ornament for a stocking is attached by fusing is disclosed.

U.S. Pat. No. 2,596,965 to Troy discloses a stocking which has an ornament attached by adhesive.

U.S. Pat. No. 2,667,004 to Sanson discloses a stocking with an ornament which can be detachably mounted on hosiery.

U.S. Pat. No. 6,014,973 to Kaufman discloses various healing elements which are worn on the body of a user, for example in a pouch.

In the present invention a pantyhose/stocking incorporates various types of healing devices such as, but not limited to, crystals for healing various bodily ailments all as will be detailed in the specification that follows hereafter.

SUMMARY OF THE INVENTION

This invention relates to a stocking or hosiery which incorporates various types of naturally occurring healing devices such as, but not limited to, crystals for healing various bodily ailments.

It is the primary object of the present invention to provide for an improved type of stocking or pantyhose which incorporates healing elements.

Another object is to provide for such a stocking in which the healing elements are natural occurring earth elements incorporated into the stocking either at the waistband front or back , or both, or the region of the upper ankle band.

These and other objects and advantages of the present invention will become apparent to readers from a consideration of the ensuing description and the accompanying drawings.

DESCRIPTION OF THE PREFERRED EMBODIMENT

Figure 1A:
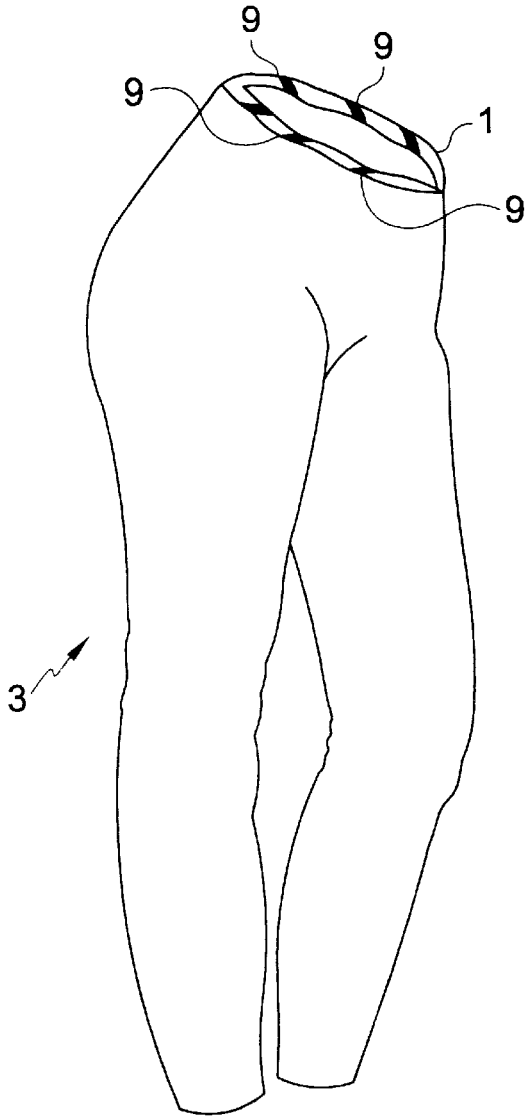
FIG. 1(*a*) and 1(*b*) are perspective views of the present invention showing the elements incorporated into the waistband, front and back, of pantyhose, FIG. 1(*a*), and in the front or back of the waistband of pantyhose.
Figure 1B:
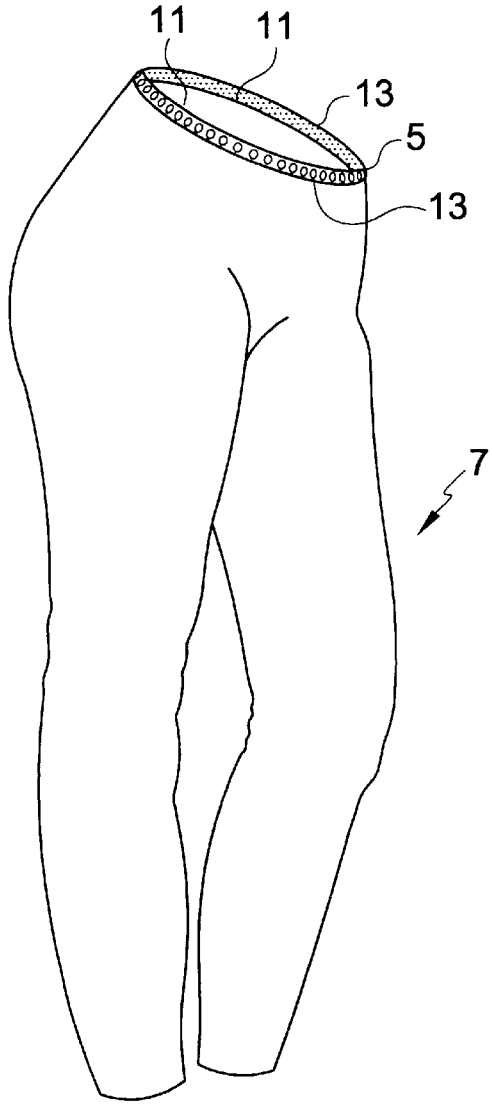

FIG. 1(*a*) and FIG. 1(*b*) are perspective views of the present invention showing the incorporated into the waistband 1, front and back, of pantyhose 3, FIG. 1(*a*), and in the front or back of the waistband 5 of pantyhose 7. The terms stocking, hosiery and pantyhose are used interchangeably herein unless the content indicates otherwise. Except for the incorporation of the naturally occurring elements into the waistbands, both of the pantyhose 3 and 7 are conventional in design and fabric content and have no lower foot sock portion. Nylon or other artificial or natural fabrics conventionally used could be employed in making the pantyhose.

In FIG. 1(*a*) the waistband 1 has naturally occurring element incorporated into the front and back portions of the waistband. Healing elements as used in herein include naturally occurring elements that allow the natural healing power of the body to be manifest. Included in this long list of healing elements are: Alexandrite, Amazonite, amber, Amethyst, Aquamarine, Aventurine, Azurite, Bloodstone, Calcite, Carelian, Celestite, Chrysoprase, Citrine, Diamond, Dioptase, Emerald, Fluorite, Garnet, Gold, Hematite, Herkimer Diamond, Jade, Jasper, Kunzite Pink, Lapis Lazuli, Lepidolite, Malchite, Moonstone, Obsidian, Onyx, Opal, Peridot, Pyrite, Quartz Crystal, Rhodochrosite, Rhodonite, Rose Quartz, Ruby, Rutilated Quartz, Smoky Quartz, Sugilite, Sodalite, Sapphire, Silver, tiger Eye, Topaz, Tourmaline, Turquoise, Zircon. Certain beneficial results have been attributed to each of these healing elements as follows:

Lepidolite, Maichite, Moonstone, Obsidian, Onyx, Opal, Peridot, Pyrite, Quartz Crystal, Rhodochrosite, Rhodonite, Rose Quartz, Ruby, Rutilated Quartz, Smoky Quartz, Sugilite, Sodalite, Sapphire, Silver, tiger Eye, Topaz, Tourmaline, Turquoise, Zircon. Certain beneficial results have been attributed to each of these healing elements as follows:

Alexandrite—Has positive influence on nervous system. Spleen and pancreas helps align mental and emotional body. Joy oneness with life.

Amazonite—Strengthens heart and physical body. Facilitates clearer vision of one's own harmful tendencies. Joy and upliftment.

Amber—Exerts positive influence on endocrine system. Electrically alive. Harmonizing.

Amethyst—Strengthens endocrine and immune systems. Enhances right brain activity. Cuts through illusion. Excellent for meditation.

Aquamarine—Calms nerves, reduces fluid retention, helps banish fears and phobias. Peace.

Aventurine—Stimulates muscle tissue. Emotional tranquility. Independence.

Azurite—Enhances flow of energy through nervous system. Strengthens blood. Creativity.

Bloodstone—Strengthens and oxygenates bloodstreanis. Aids in balancing iron deficiencies. Idealism.

Calcite—Balances male/female polarities. Emotionally balancing. Ground excess energy. Joy.

Carelian—Very highly evolved mineral healer. Aids tissue regeneration. Enhances attunement with inner self Celestite—Enhances thyroid functions. Reduces stress. Aids personal creative expression. Truth.

Chrysoprase—Balances neurotic patterns. Eases depression. Brings out inner talents.

Citrine—Good for kidneys. Raises self-esteem. Abundance.

Diamond—Aids alignment of cranial bones. Master healer. Purity.

Dioptase—Strengthens cardiovascular and central nervous system. Excellent aid for blood pressure. Well-being.

Emerald—Strengthens heart and liver. Aids alignment of subtle bodies. Prosperity.

Fluorite—Improves absorption of vital nutrients. Beneficial for blood vessels. Powerful healer.

Garnet—Strengthens, purifies. Helping to harmonize the potent forces. Stimulates pituitary gland. Love.

Gold—Purifies and energizes physical body. Improves circulation. Aids tissue regeneration. Amplifies thought.

Hematite—Has positive affect upon bloodstream. Increases resistance to stress. Optimism.

Herkimer Diamond—Cleanses subtle bodies. Reduces stress. Powerful amplifier. Awareness.

Jade—Strengthens heart and immune system. Aids eye disorders and female problems. Wisdom.

Jasper—Strengthens gallbladder. Impact on physical body. Powerful healer.

Kunzite Pink—Strengthens cardiovascular system. Tolerance, acceptance, calming.

Lapis Lazuli—Strengthens skeletal system. Releases tension. Augments strength. Clarity Lepidolite—Aids muscles, strengthens heart. Aids sleep. Joy.

Malchite—Aids functions of pancreas and spleen. Vitalizing for body and mind. Reveals subconscious blocks.

Moonstone—Has healing affinity with stomach. Relieves anxiety and stress. Aids birthing process. Flexibility in attitudes.

Obsidian—Beneficially influences stomach and intestines. Grounds spiritual energy into physical plane. Helps clear subconscious blocks.

Onyx—Balances male/female polarities. Strengthens bone marrow. Self-control.

Opal—Stimulates pineal and pituitary glands. Emotional balancer. Enhances intuition.

Peridot—Balances glandular system. Purifies body, enhances bloodstream, reduces stress. Personal growth Pyrite—Strengthens and oxygenates blood. Enhances brain functions. Enhances emotional body Harmony Quartz Crystal—Enhances the crystalline properties of blood. Activates and enhances pineal and pituitary gland. Excellent for meditation.

Rhodochrosite—Aids spleen, kidneys, and heart. Enhances memory. Acceptance of self and life Rhodonite—Aids central nervous system. Body reflexes. Reduces stress, calms mind. Strength.

Rose Quartz—Aids circulatory system. Reduces stress and tension. Love stone.

Ruby—Aids in regeneration of physicallspysical heart. Activates sluggish or dormant conditions.

Rutilated Quartz—Regeneration of tissue throughout body. Stimulates brain functions. Communication Smoky Quartz—Strengthens adrenals. Mildly sedative and relaxing. Excellent for meditation.

Sugilite—Enhances functions of pineal, pituitary, and adrenal glands. Activates and balances brain hemispheres. Sensitivity.

Sodalite—Strengthens metabolism and lymphatic system. Alleviates fear. Truth.

Sapphire—Strengthens heart and kidneys. Aids glandular system. Strengthens will.

Selenite—Strengthens bones and teeth. Has positive effect on brain. Clarity.

Silver—Enhances mental functions. Excellent energy conductor. Speech.

Tiger Eye—Beneficial for spleen, pancreas, digestive organs, and colon. Emotional balances Helps soften stubbornness. Insight.

Topaz—Gold—Detoxifies body. Abundance.

Blue—Tissue regeneration. Strengthens thyroid. Tranquility.

Tourmaline—Aids sleep. Aligns subtle bodies. Inspiration.

Turquoise—Tones, strengthens entire body. Creative expression. Friendship and loyalty.

Zircon—Aids bowel problems Emotional balance. Self-esteem. All around healer.

Another well known healing element not on the above list is copper. Copper is one of the natural crystals of the earth and allows the natural healing power in the body to be manifested. Reportedly the phenomenal crystal "copper" when applied to the body allows the positive and negative ions of the body to produce and obtain and maintain therapeutic wellness. It would find use in person afflicted with leg and lower back pain, tendinitis and such diseases as pulmonary disease. It is not intended to be a medical device or a substitute for a prescribed medication but simply brings the grounding of ones alignment with their center of energetic healing power.

The naturally occurring healing elements are normally presented in the form of crystals and may be crushed altered, fine fibers, thin pellet disks or half/whole crystals that are incorporated into the material making up the pantyhose/stocking. For example, in FIG. 1(*a*), the material 9 incorporated into the waistband 1 takes the form of whole crystals of the healing element incorporated into both the front and back portions of the waistband. In the next figure, FIG. 1(*b*), the healing elements take the form of thin pellet disks that are incorporate either into the back 11 or the front 13 of the waistband 5, but not both sides.

Figure 2:
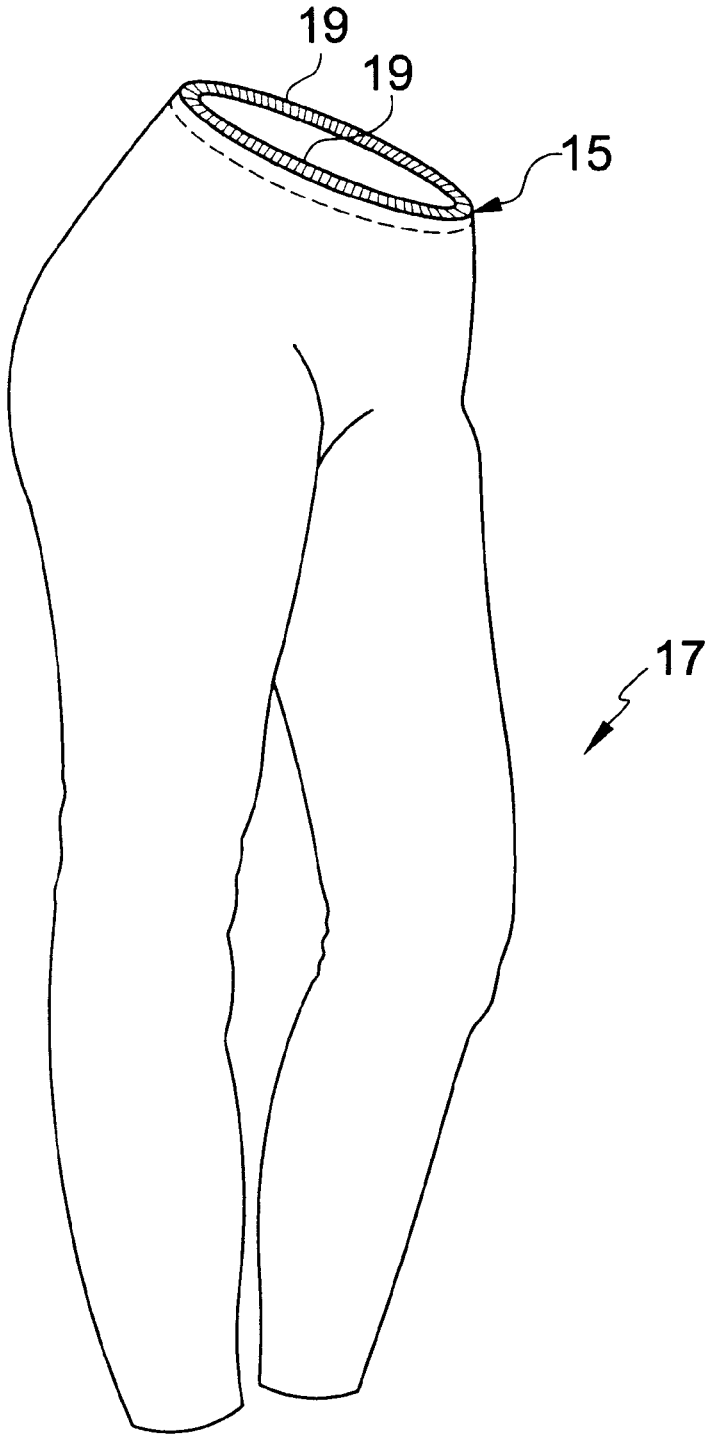
FIG. 2 is perspective view of pantyhose illustrating the waistband incorporation of fine fibers of elements.

FIG. 2 is perspective view of pantyhose illustrating the waistband incorporation of fine fibers of elements. This figure relates to FIG. 1(*a*) and FIG. 1(*b*), but differs in that the healing elements incorporated into the waistband 15 of the pantyhose 17 take the form of fine fibers 19. Small dotes are used to represent the fine fibers 19. As with the first two figures the fine fibers may be either in the front and back of the waistband or may be either in the front or back of the waistband.

Figure 3A:
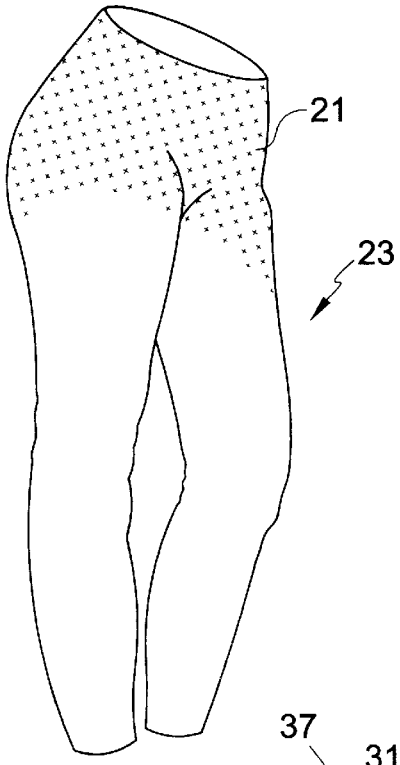
FIGS. 3(*a*) to (*c*) are perspective views of pantyhose incorporating the healing elements into different locations of pantyhose.
Figure 3B:
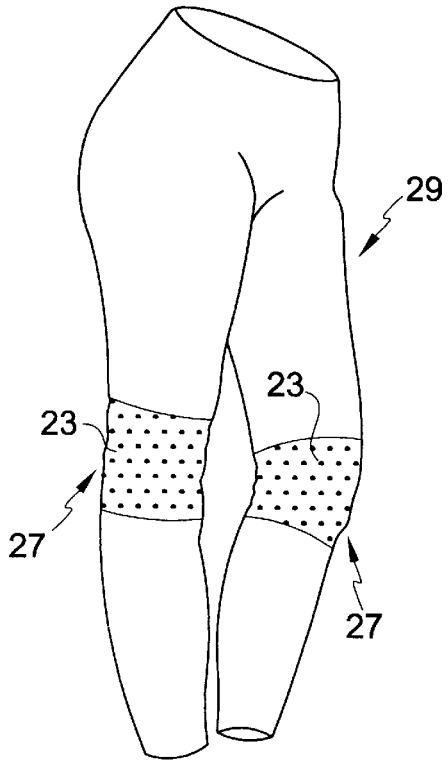
Figure 3C:
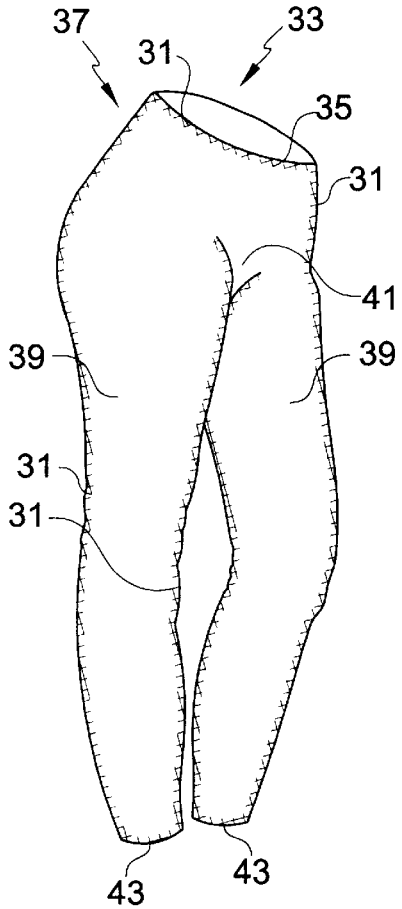
Figure 4A:
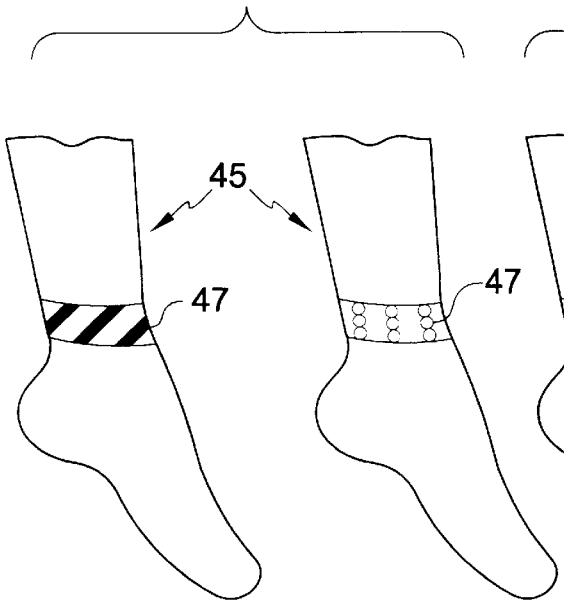
FIGS. 4(*a*) to (*d*) are perspective views of pantyhose incorporating healing elements into upper ankle bands of pantyhose.
Figure 4B:
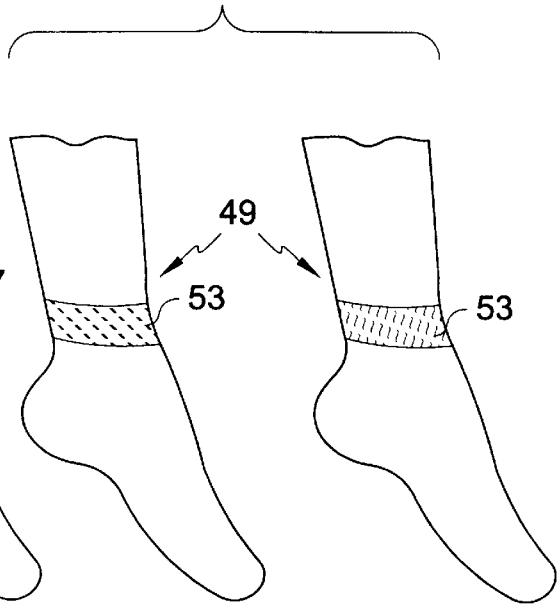
Figure 4C:
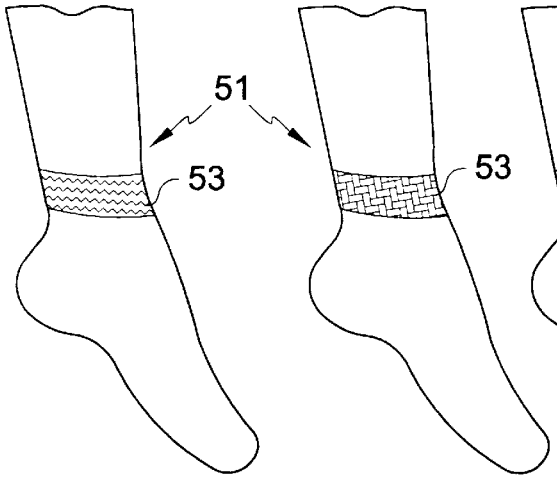
Figure 4D:
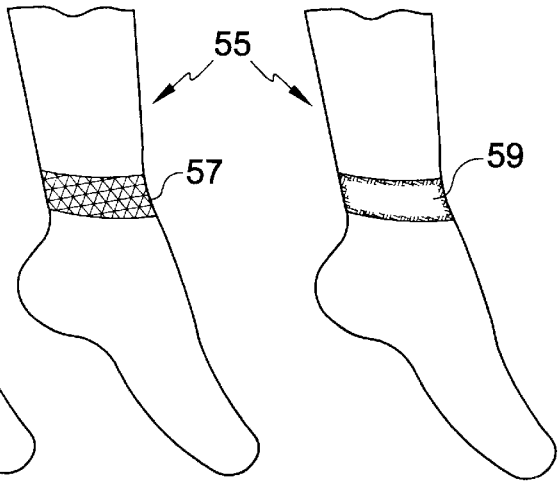

FIGS. 3(*a*) to (*c*) are perspective views of three different conventional pantyhose each of which incorporates healing elements into different locations on pantyhose. In all three views the healing elements are crushed altered and incorporated into the fabric making up the pantyhose. In FIG. 3(*a*) the healing elements 21 are incorporates into the upper portion of the pantyhose 23 and are represented by dots. These elements extend downwardly from the waistband and end at about the crotch area of the pantyhose. The incorporated elements may be on all sides of the pantyhose or only the front or back as desired.

In FIG. 3(*b*) the crushed altered healing elements 25 are incorporated into the two knee areas 27 of the pantyhose 29. Clearly, if the beneficial results are only desired for one knee area, then only that area need have the incorporation of the healing elements built into the pantyhose.

The next figure, FIG. 3(*c*), shows the crushed altered healing elements 31 incorporated into the peripheral outline which defines the shape of the pantyhose 33. Included would be elements incorporated into the waistband 35, the buttocks 37, the length of both legs 39 and the crotch area 41. Even the lower opened leg opening ends 43 of the pantyhose has the healing element incorporated around the area above the ankle of a user.

FIGS. 4(*a*) to (*d*) are perspective views of pantyhose illustrating the incorporation of elements into upper ankle bands. The ankle bands would normally be about 3 to 4 inches above the bottom of a user's foot. The bands would serve the additional function of holding the lower portion of the pantyhose in place and keeping the support throughout. Several reinforcing materials could be used to make the ankle bands including VELCRO (i.e., hook and loop fasteners), LYRCA, elastic fiber or silicone.

Each of the individual figures FIG. 4(*a*), 4(*b*), 4(*c*) and 4(*d*) show the lower portion of pantyhose with two upper ankle bands. The distinguishing characteristic between these figures is that the form of the healing elements incorporated into the ankle bands is different in each figure. For example, in FIG. 4(*a*) the elements incorporated into the ankle bands of the pantyhose 45 take to form of crushed altered elements 47. In FIGS. 4(*b*) and FIG. 4(*c*), the elements incorporated into the ankle bands of the panty hoses 49 and 51 take to form of crushed altered elements 53. The last figure, FIG. 4(*d*), shows the healing elements incorporated into the ankle portion of the pantyhose 55 in the form of whole 57 and half crystals 59 of the healing elements.

In the examples shown and described the pantyhose were of the preferred footless design . Thus, allowing for the use of the pantyhose with saddles or opened toed shoes or the like. However, adding a lower foot engaging sock portion to the pantyhose could be done if desired. The term "stocking" as used in the claims to follows includes as is appropriate to the claim language, pantyhose with or without a foot engaging portions, stockings or hosiery that do not reach to the users waist or knee, as is appropriate. Choosing the particular healing element to be incorporated into the stocking would depend on the results desired and can vary as to the element chosen, the affliction to be treated or the region of the body afflicted.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A stocking having healing elements incorporated into the stocking comprising:

a stocking made of a fabric adapted to fit over at least a portion of the leg of a user, said stocking comprising two leg portions and a connected upper waistband portion, a naturally occurring healing element being incorporated into the fabric of the waistband portion of said stocking, and said naturally occurring healing element being selected by the user depending on the affliction to be treated.

2. The stocking as claimed in claim 1, wherein the healing element incorporated into the fabric of the waistband portion of said stocking is in the form of whole crystals made from the healing element located in the front and rear portions of the stocking waistband.

3. The stocking as claimed in claim 1, wherein the healing element incorporated into the fabric of the waistband portion of said stocking is in the form of thin pellet disks of the healing element located in the front or in the rear portion of the waistband.

4. The stocking as claimed in claim 1 wherein the healing element incorporated into the fabric of the waistband portion of said stocking is in the form of fine fibers of the healing elements located in the waistband of the stocking.

5. The stocking as claimed in claim 1, wherein stocking additionally includes a front crotch portion and a buttock portion, said naturally occurring healing element being incorporated in the fabric of the waistband portion being in the area that covers the front crotch portion and buttocks of a user when worn.

6. The stocking as claimed in claim 1, wherein said stocking additionally includes knee covering areas, said naturally occurring healing element being incorporated into the knee covering areas of the stocking.

7. The stocking as claimed in claim 1, wherein said stocking additionally includes a front crotch portion and a buttock portion, said naturally occurring healing element being incorporated into the stocking in at least a portion of the stocking leg portion, front crotch portion and the buttock portion.

8. The stocking as claimed in claim 1, wherein each of the two leg portions having an ankle band portion, said ankle band portion incorporating said healing element.

9. The stocking as claimed in claim 1, wherein healing element is copper.

* * * * *